United States Patent [19]

Laing et al.

[11] Patent Number: 4,678,734

[45] Date of Patent: Jul. 7, 1987

[54] PROCESS FOR DEVELOPER COMPOSITIONS

[75] Inventors: John R. Laing, Rochester; C. D. Zimmer, Ontario; Deepak R. Maniar, Penfield, all of N.Y.; Meurig W. Williams, Memphis, Tenn.

[73] Assignee: Xerox Corporation, Stamford, Conn.

[21] Appl. No.: 751,821

[22] Filed: Jul. 5, 1985

[51] Int. Cl.[4] ..... G03G 9/10

[52] U.S. Cl. ..... 430/137; 430/108

[58] Field of Search ..... 430/137, 108, 109; 427/212, 216, 220

[56] References Cited

U.S. PATENT DOCUMENTS 3,970,571 7/1976 Olson et al. ..... 252/62.1 P 4,233,387 11/1980 Mammino et al. ..... 430/137

*Primary Examiner*—John L. Goodrow

*Attorney, Agent, or Firm*—E. O. Palazzo

[57] ABSTRACT

A process for the preparation of developer compositions which comprises (1) providing carrier particles consisting of a core with a coating thereover; (2) introducing the carrier particles into a blending apparatus; (3) adding to the blending apparatus fine toner particles with a diameter of from about 2 microns to about 10 microns, said particles being comprised of toner resin particles, pigment particles, and a charge enhancing additive; (4) affecting blending for a period of time sufficient to enable the classified toner particles to alter the tribogenerating ability of the surface of the carrier particles and become embedded therein; (5) subsequently adding to the resulting blended mixture toner particles of a diameter of from about 2 to about 18 microns, and comprised of toner resin particles, pigment particles, and a charge enhancing additive; and (6) blending for a period of form about 1 minute to about 5 minutes.

32 Claims, 4 Drawing Figures

Figure 1:
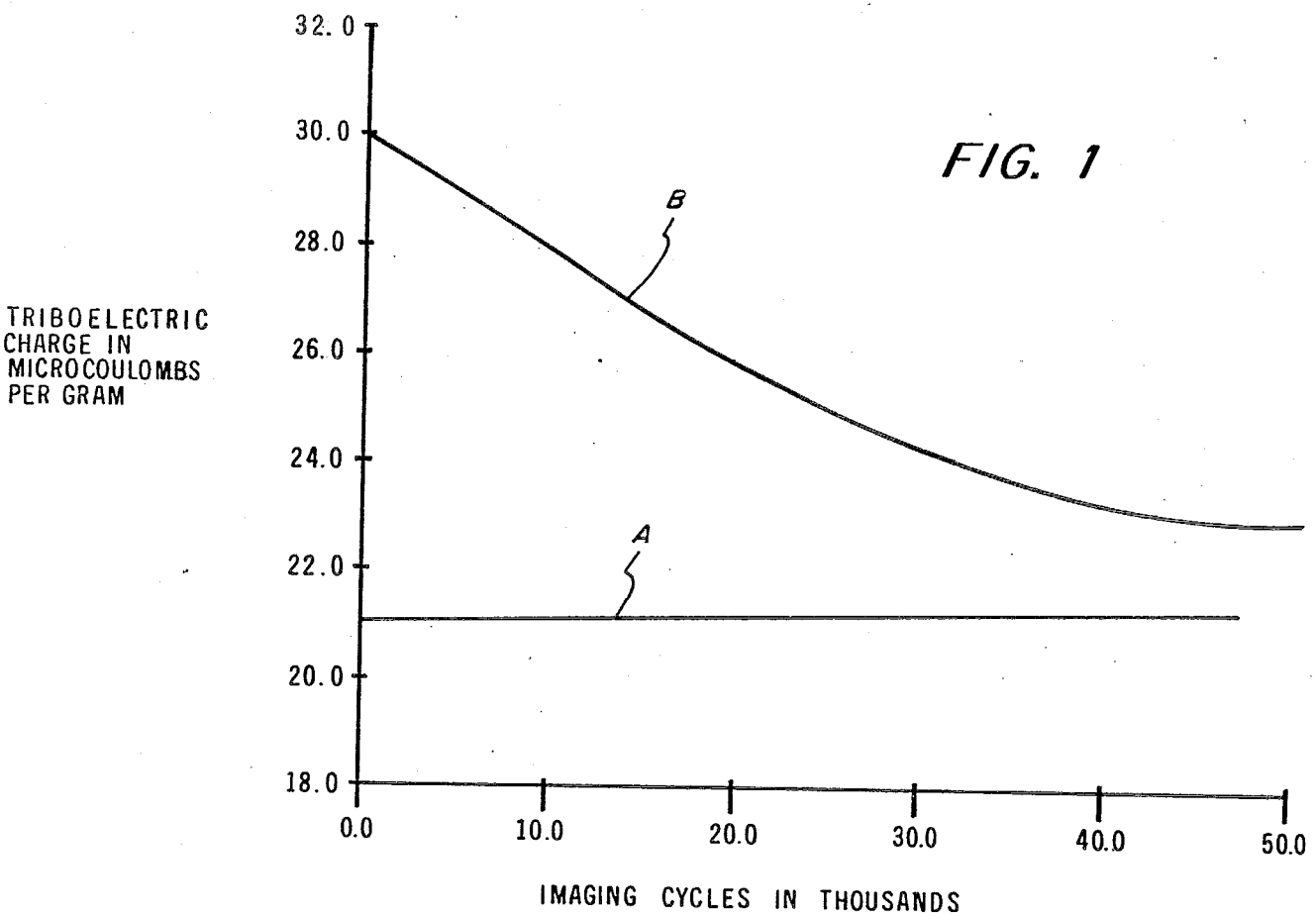

B
A
32.0
30.0
28.0
26.0
24.0
22.0
20.0
18.0
TRIBOELECTRIC CHARGE IN MICROCOULOMBS PER GRAM
0.0
10.0
20.0
30.0
40.0
50.0
IMAGING CYCLES IN THOUSANDS

PROCESS FOR DEVELOPER COMPOSITIONS

BACKGROUND OF THE INVENTION

This invention is generally directed to processes for affecting the preparation of developer compositions, and more specifically the present invention is directed to processes for obtaining developer compositions with relatively stable electrical properties inclusive of consistent triboelectric charging values. Also, in accordance with the process of the present invention there results developer compositions with acceptable charge distributions, and constant conductivity characteristics. In one embodiment, therefore, the process of the present invention comprises blending carrier particles with fine toner particles of a specific diameter as indicated hereinafter; and containing therein a charge enhancing additive followed by adding to the resulting blended composition a toner comprised of the same components of the fine toner with the exception that the aforementioned toner particles are of a larger diameter. The aforementioned process enables developer compositions, immediately subsequent to their preparation, with a substantially constant triboelectric charge, that is beginning with the first imaging cycle, and extending to a relatively unlimited number of imaging cycles. There is thus achievable with the process of the present invention two component developer compositions possessing stable triboelectric charging characteristics for a substantially unlimited number of imaging cycles exceeding, for example 100,000. Accordingly, the developer compositions prepared in accordance with the present invention are useful for electrostatographic imaging processes, particularly those processes wherein there is selected a positively charged layered photoresponsive imaging member comprised of a photogenerating layer and an aryl amine hole transport layer, reference U.S. Pat. No. 4,265,990, the disclosure of which is totally incorporated herein by reference.

Numerous different processes are known for affecting the preparation of toner compositions. One of the most widely used processes involves the melt blending of toner resin particles, pigment particles, and charge enhancing additives, followed by mechanical attrition. Other similar methods include spray drying, dispersion polymerizations, melt extrusions and the like. Developer compositions can then be prepared by admixing the toners obtained with carrier particles. While these processes are sufficient for their intended purposes, there is usually obtained toner compositions which initially are of a high triboelectric charge that decreases subsequent to a specific number of imaging cycles depending, for example, on the components of the developer selected. Additionally, electrostatic images initially rendered visible with developer compositions prepared in accordance with, for example the prior art melt blending methods, are of lower quality in that undesirable background deposits are observable. This quality will eventually improve after, for example, about 100 copying cycles. The process of the present invention addresses this prior art problem and enables developer compositions which possess acceptable desirable triboelectric charges beginning with the first imaging cycle; and wherein these compositions permit developed images of high resolution and no background deposits to be generated for extended time periods.

There are disclosed in U.S. Pat. No. 3,970,571 method for preparing artificially aged or preconditioned dry developers having desirable characteristics which continue uniformly from the first imaging cycle through many thousands of prints, reference the disclosure in column 1, beginning at line 7. According to the teachings of this patent, an artifically aged or preconditioned dry electrophotographic developer is prepared in accelerated fashion so as to simulate the characteristics of a normally aged developer by the steps of combining an unconsolidated mass of finely divided carrier particles and an unconsolidated mass of suitably finely divided resin based toner particles containing a suitable charge control agent in substantially greater concentration, preferably six times greater than is desired in the final developer, followed by intermittently mixing the combined ingredients by tumbling; and proceeding in accordance with the other steps, reference the disclosure in column 3, beginning at line 20, and continuing on to column 4, line 35. The critical parameters for the process of the U.S. Pat. No. 3,970,571, as emphasized in the disclosure and working examples, include the mixing of the mass of resin particles with a charge control agent in greater concentration that that desired in the free toner particles; and subsequently introducing into and intermittently mixing with the resulting mixture an additional quantity of resin toner particles containing a charge control agent to increase the concentration of the free toner particles up to that desired in the developer after preconditioning. Examples of charge control agents disclosed in this patent are quaternary ammonium compounds, amines, and similar substances, see the disclosure in columns 7 and 8.

Further, there is disclosed in U.S. Pat. No. 4,304,830 a process for achieving rapid admixing of developer compositions. More specifically, there is disclosed in this patent a process for rapidly charging uncharged toner particles being added to a developer composition containing toner particles and carrier particles characterized in that there is added to the toner and/or developer composition an alkyl pyridinium compound or its hydrate. There is also disclosed in several other patents and in copending applications processes for achieving rapid admix. For example, there is illustrated in U.S. Pat. No. 4,524,120 the disclosure of which is totally incorporated herein by reference, a process for charging toner compositions which comprises (I) adding uncharged replenishment toner particles to a charged developer composition comprised of carrier particles and toner particles, the carrier particles consisting of a core containing a continuous polymer coating thereover having incorporated therein a fluoropolymer, contained on from about 1 percent to about 20 percent of the surface area of the coating; and (II) contacting the charged developing composition containing said carrier particles with uncharged toner particles, wherein charges are transferred to the uncharged toner particles within a mixing period of from about 5 seconds to about 5 minutes, thereby resulting in substantially the same level of charge intensity for said uncharged toner particles as the charge intensity for the uncharged toner particles in the charged developer composition.

Nevertheless, there remains a need for new processes that will permit developer compositions with stable triboelectric charging properties. Further, there is a need for processes that will enable two component developer compositions with stable triboelectric charging characteristics for substantially unlimited imaging cycles. Also, there is a need for processes allowing the generation of two component developers with reduced aging characteristics. Aging, a prevalent problem in many xerographic imaging processes, causes, for example, a continuous reduction in toner charging capability which eventually results in copy quality degradation as evidenced, for example, by excessive background printout. Moreover, there is a need for processes enabling two component developer compositions with triboelectric charging values of from about 15 microcoulombs per gram to about 35 microcoulombs per gram, beginning with the first imaging cycle, and extending to an excess of 100,000 imaging cycles. There is also a need for processes that permit the generation of developer compositions with narrow charge distribution characteristics, and a conductivity of from about $10^{-11}$ (ohm-cm)$^{-1}$ to about $10^{-7}$ (ohm-cm)$^{-1}$ for an extended number of imaging cycles. The aforementioned developer conductivity values were obtained by measurements in a magnetic brush device. In this device, the developer composition was placed on a 1.5 inch diameter magnetic roll, followed by measuring the conductivity with an electrical probe. Specifically, the conductivity was obtained by measuring with a probe the amount of current which passes through the carrier composition, or the developer composition to a measurement electrode for a specific applied voltage V. The measurement electrode, surrounded by a grounded guard plate, has a surface area of 3.0 $cm^2$ and the developer roll to electrode spacing was 2.54 millimeters. For these spacings, the cell constant is 0.0847 $cm^{-1}$ (0.254 divided by 3.0), and the developer conductivity, in (ohm-cm)$^{-1}$, is the cell constant multiplied by the current divided by the applied voltage.

SUMMARY OF INVENTION

It is an object of the present invention to provide improved processes for permitting the preparation of toner and developer compositions which overcome many of the above-noted disadvantages.

In another object of the present invention there are provided processes for obtaining two component developer compositions with stable triboelectric charging values.

In another object of the present invention there are provided processes enabling two component developer compositions with acceptable positive triboelectric charging values beginning with the first imaging cycle.

In still another object of the present invention there are provided processes for obtaining images of consistent high quality for extensive time periods with a two component developer composition that retains its triboelectric charging values.

In yet a further object of the present invention there are provided imaging processes with two component developer compositions prepared by specific processes as illustrated hereinafter, and wherein there are provided developed images of excellent resolution and substantially no background deposits.

A further object of the present invention resides in processes for obtaining developer compositions which maintain other important electrical properties, inclusive of electrical resistance, that is, a conductivity of from about $10^{-11}$ (ohm-cm)$^{-1}$ to about $10^{-7}$ (ohm-cm)$^{-1}$ beginning with the first imaging cycle.

Another object of the present invention resides in a blending process for obtaining developer compositions with narrow toner charge distribution values thereby enabling images of excellent resolution with no background deposits.

These and other objects of the present invention are accomplished by providing a process for affecting the preparation of developer compositions which maintain their triboelectric charging characteristics and desirable development properties for substantially unlimited imaging cycles. Accordingly, with the process of the present invention, there results two component developer compositions that possess substantially identical triboelectric charging values beginning with the first imaging cycle; and continuing on for an unlimited number of imaging cycles, that is for example, until the toner composition has been exhausted from the developer reservoir, or about 100,000 to 300,000 imaging cycles with some machine configurations.

Therefore, in one embodiment, the present invention is directed to a process for the preparation of developer compositions which comprises (1) providing carrier particles consisting of a core with an optional coating thereover; (2) introducing the carrier particles into a blending apparatus; (3) adding to the blending apparatus classified toner particles with a diameter of from about 2 micron to about 10 microns, said particles being comprised of toner resin particles, pigment particles, and a charge enhancing additive; (4) affecting blending for a period of time sufficient to enable the classified toner particles to alter the tribocharging ability of the carrier particles and become embedded therein; (5) subsequently adding to the resulting blended mixture toner particles of a diameter of from about 6 to about 18 microns, and comprised of toner resin particles, pigment particles, and a charge enhancing additive; and (6) blending for a period of from about 1 minute to about 5 minutes. More specifically, thus there is provided in accordance with the present invention a process for the preparation of developer compositions with substantially stable triboelectric properties which comprises (1) providing carrier particles consisting of a core with an optional, preferably semicontinuous coating thereover; (2) subsequently introducing an appropriate amount, generally from about 12 to 1,200 pounds, of carrier particles into a blending apparatus; (3) thereafter adding in an effective amount, generally from about 0.1 percent to 1.2 percent by weight, based on the weight of the carrier to the blending apparatus, classified toner particles with an average diameter of about 3 to 7, and preferably about 5 microns, which particles are comprised of polymeric resins, pigment particles, and a charge enhancing additive; (4) blending the aforementioned mixture for a sufficient time period, about 20 minutes to about 90 minutes, enabling the classified toner particles to alter or lower the tribogenerating ability of the surface of the carrier particles, and to become embedded therein; and (5) adding to the blender toner particles in an amount generally of from about 0.8 to 2.5 percent by weight, based on the weight of the carrier particle, with an average diameter of 9 to 12 microns, and preferably 11 microns, and comprised of the same constituents as the particles added in step (3); and affecting further blending for a period of from about 1 minute to about 5 minutes, and preferably for about two minutes.

In one preferred aspect of the present invention, there is provided a process for preparing developer compositions which comprises (1) providing carrier particles consisting of an oxidized grit steel core containing thereover a semicontinuous or continuous coating of polyvinylidine fluoride, which carrier particles are prepared as described in U.S. Pat. No. 4,233,387, the disclosure of which is totally incorporated herein by reference; (2) introducing the carrier particles into a blending apparatus; (3) subsequently adding to the blending apparatus classified toner particles with an average diameter of from about 2 to about 10 microns, and preferably less than about 5 microns, said toner particles comprised of a styrene n-butylmethacrylate copolymer, carbon black pigment particles, and the charge enhancing additive cetyl pyridinium chloride; (4) affecting vigorous blending of the resulting mixture for a period of time, typically about 20 to about 60 minutes, to enable the classified toner particles to impact the carrier particles and become embedded therein, and to alter the tribogenerating ability of the surface of the carrier particles; (5) adding to the blender toner particles with an average diameter of from about 6 to about 18 microns, and preferably about 9 to about 12 microns; and consisting of a styrene and n-butylmethacrylate copolymer resin, carbon black pigment particles, and the charge enhancing additive cetyl pyridinium chloride; and (6) accomplishing further blending for a period of from about 1 minute to about 5 minutes, and preferably for about two minutes. In one further preferred embodiment, the toner particles selected for the process of the present invention are comprised of about 92 percent by weight of a styrene n-butylmethacrylate copolymer, 6 percent by weight of carbon black particles, and 2 percent by weight of the charge enhancing additive cetyl pyridinium chloride.

There results in accordance with the process of the present invention two component developer compositions with a positive triboelectric charge thereof of from about 15 microcoulombs per gram to about 35 microcoulombs per gram, and preferably from about 20 microcoulombs per gram to about 30 microcoulombs per gram. The aforementioned triboelectric charging characteristics are achievable with the first imaging cycle and remain at the values indicated for a substantially unlimited number of imaging cycles as illustrated with reference to FIG. 1. Furthermore, the resulting developer compositions have conductivity values of from about $10^{-11}$ (ohm-cm)$^{-1}$ to about $10^{-7}$ (ohm-cm)$^{-1}$, and preferably from about $10^{-9}$ (ohm-cm)$^{-1}$ to about $10^{-7}$ (ohm-cm)$^{-1}$.

FIG. 1 represents a plot illustrating the triboelectric aging properties versus time in imaging cycles for two developer compositions, one prepared in accordance with the prior art, reference curve B; and a developer composition prepared in accordance with the process of the present invention, curve A. This curve clearly demonstrates that the prior art developer composition B initially has a triboelectric charging value of 30 microcoulombs per gram which decreases continuously to a value of 23 microcoulombs per gram after 40,000 imaging cycles in a xerographic imaging test fixture; while with the developer composition prepared in accordance with the process of the present invention, line A, the developer composition has a substantially identical triboelectric charging value beginning with the first imaging cycle and continuing on to over 40,000 imaging cycles, this value being 21 microcoulombs per gram. Toner compositions A and B as represented in FIG. 1 contain the identical components, that is, 92 percent by weight of a styrene n-butylmethacrylate copolymer, 6 percent by weight of carbon black, 2 percent by weight of the charge enhancing additive cetyl pyridinium chloride, and about 98 parts by weight of carrier particles consisting of a steel core coated with 0.155 percent by weight of a polyvinylidine fluoride resin. Also, the triboelectric charge generated by the above-identified developer compositions was measured by the known Faraday cage technique as described, for example, in U.S. Pat. No. 3,526,533, the disclosure of which is totally incorporated herein by reference.

The developer composition represented by line A is prepared in accordance with the process illustrated herein, reference Example I; while the developer composition illustrated with reference to curve B is prepared in accordance with prior art processes which involves the following steps: (1) providing carrier particles consisting of a core with semicontinuous coating thereover; (2) subsequently introducing the carrier particles in an amount of from about 12 to 1,200 pounds into a blending apparatus; (3) thereafter adding to the blending apparatus toner particles in an amount of from about 1.5 to about 4 percent by weight based on the weight of the carrier particles, and with an average diameter of from about 8 to 12, and preferably 10.5 microns; and comprised of polymer resins, pigment particles, and a charge enhancing additive; and (4) blending the mixture for a sufficient time period, about 10 to 60 minutes, and preferably about 20 minutes, to produce a triboelectric charge on the toner of about 20 to about 40 microcoulombs per gram.

Various suitable carrier components can be selected for the process of the present invention including steel, iron ferrites, inclusive of the ferrites described in U.S. Pat. No. 3,914,181, the disclosure of which is totally incorporated herein by references, and reclaimed ferrites. Other carrier particles not specifically disclosed herein can be selected providing the objectives of the present invention are achieved. These carrier particles are generally of a diameter of from about 50 microns to about 250 microns; and are mixed with the toner composition in various suitably effective compositions including, for example, 1/5 part to about 5 parts per toner to about 100 parts to about 200 parts by weight of carrier, and preferably from about 1 to about 5 parts by weight of toner to about 100 parts by weight of carrier particles. Carrier particles selected for the process of the present invention preferably have a semicontinuous or continuous coating thereover illustrative examples of which include fluoropolymers, terpolymers of styrene acrylate, reference U.S. Pat. Nos. 3,467,634 and 3,526,533, the disclosures of which are totally incorporated herein by reference; and siloxanes polymethyl methacrylates, and the like. A preferred coating is a polyvinylidine fluoride, commercially available as Kynar, present at a coating weight of 0.12 to 0.20, and preferably 0.155 percent by weight. Other coatings not specifically illustrated herein can be selected providing the objectives of the present invention are achieved.

In one very preferred embodiment, the carrier particles resulting from the process as described in U.S. Pat. No. 4,233,387, the disclosure of which has been totally incorporated herein by reference, are selected. These carrier particles are formulated by, for example, the steps of mixing low density, porous, magnetic or magnetically-attractable metal carrier core particles having a gritty, oxidized surface and a surface area of at least about 200 cm$^2$/gram and up to about 1300 cm$^2$/gram, with from between about 0.05 percent and about 3.0 percent by weight based on the weight of the coated carrier particles, of a particulate thermoplastic resin material having a particle size of between about 0.1 micron and about 30 microns; dry mixing said carrier core particles and said thermoplastic resin material until said thermoplastic resin material adheres to said carrier core particles by mechanical impaction or electrostatic attraction; heating the mixture of carrier core particles and thermoplastic resin material to a temperature of between about 320° F. and about 650° F. for between about 120 minutes and about 20 minutes permitting said thermoplastic resin material to melt and fuse to said carrier core particles; cooling the coated carrier particles; and classifying said coated carrier particles to the desired particle size.

Examples of blending apparatuses that may be selected for the process of the present invention are a roll mill, ball mill, or any type of blender with a stationary shell and rotating plows, such as those made by Lodige; and twin shell blenders or a Munson mixer.

Various suitable known toner compositions can be selected for the process of the present invention including compositions comprised of resin particles, pigment particles, and charge enhancing additives. Examples of suitable toner resins selected are as illustrated in U.S. Pat. No. 4,298,672, the disclosure of which is totally incorporated herein by reference, such as styrene polymers, styrene methacrylates, styrene acrylates, and styrene acrylonitriles, as well as styrene butadiene polymers. The preferred toner resins are styrene methacrylate polymers comprised, for example, of from about 65 percent by weight of styrene and 35 percent by weight n-butyl methacrylate. Moreover, other equivalent toner resins can be selected such as polyesters and polyamide resins.

Numerous well known pigments can be incorporated into the toner inclusive of carbon black, nigrosine dye, and mixtures thereof. The pigment is preferably comprised of carbon black present in an amount of from about 1 percent by weight to about 20 percent by weight, and preferably from about 5 percent by weight to about 10 percent by weight.

Illustrative examples of charge enhancing additives include alkyl pyridinium halides, reference U.S. Pat. No. 4,298,672, the disclosure of which is totally incorporated herein by reference; sulfonates and sulfates, reference U.S. Pat. No. 4,338,390, the disclosure of which is totally incorporated herein by reference; and ammonium sulfates as described in copending application U.S. Pat. No. 4,560,635 entitled "Toner Compositions with Ammonium Sulfate Charge Enhancing Additives", the disclosure of which is totally incorporated herein by reference. The preferred charge enhancing additive selected for the process of the present invention is cetyl pyridinium chloride. The aforementioned additives can be incorporated into the toner composition in various effective amounts. Generally, however, from about 0.1 percent by weight to about 20 percent by weight, and preferably from about 1 percent by weight to about 10 percent by weight of charge enhancing additive is selected.

With further respect to the process of the present invention, during the first step of the blending process disclosed herein the toner particles mix with the carrier particles; and are believed, although it is not intended to be limited by theory, to act in a manner so as to cause a reduction in the triboelectric charging ability of the carrier surface. Thus, for example, the triboelectric charging ability of the carrier surface can be reduced from about 30 microcoulombs per gram to about 21 microcoulombs per gram. Simultaneously, the charging ability of the toner particle is degraded. However, the selection of fine toner particles, those for example with an average diameter of from about 2 to about 10 microns, causes a substantial increase in the surface area of the toner that is able to act on the carrier surfaces without increasing the mass thereof; and permits an increase in the probability of the degraded toner particles of becoming impacted into any crevices or other spaces available on the carrier particle surface. Accordingly, the degraded toner particles become bound to the carrier surface and do not adversely impact the initial copy quality.

Similarly, in the second blending sequence a toner composition comprised of the same components as selected for the first blending operation is selected, with the important exception that the diameter of the toner particles are about 6 to 18, and preferably 11 microns. Also, the second blending sequence is accomplished for a sufficient time period to enable the production of a homogeneous mixture of toner particles and carrier particles; and also to permit the toner particles to acquire charge by admixing with, and contacting the treated carrier surface. This blending is short, typically from about 1 minute to about 5 minutes. Further, the resultant mixture has a triboelectric charge of from about 15 microcoulombs per gram to about 30 microcoulombs per gram. From about 1.25 percent to about 2.50 percent by weight of the toner is added in the second blending step, however, other amounts may be selected providing there is achieved the appropriate toner concentration that will preferably provide images with excellent resolution.

The following examples are being supplied to further define various species of the present invention, it being noted that these examples are intended to illustrate and not limit the scope of the present invention. Parts and percentages are by weight unless otherwise indicated.

EXAMPLE I

A developer composition was prepared in accordance with the prior art processes described herein, reference FIG. 1, curve B, by mixing 15 pounds of carrier particles with 3 percent by weight of toner particles with an average diameter of 10.5 microns in a Lodige blender for 20 minutes. There resulted a developer composition with carrier particles consisting of an oxidized steel core available from Toniolo Inc. having a semicontinuous coating fused (carrier core and coating mixed for 70 minutes prior to fusing, see U.S. Pat. No. 4,233,387) thereover, 0.15 percent by weight, of polyvinylidene fluoride; and a toner consisting of 92 percent by weight of a styrene n-butylmethacrylate copolymer, 6 percent by weight of carbon black and 2 percent by weight of cetyl pyridinium chloride. The initial triboelectric charge as measured in the known Faraday Cage apparatus was 30 microcoulombs per gram, which continuously decreased to 23 microcoulombs per gram after 40,000 imaging cycles in the Xerox Corporation 1075® xerographic imaging apparatus, see FIG. 1, curve B.

A second developer composition was prepared in accordance with the process of the present invention, reference the details provided hereinbefore with reference to FIG. 1, curve A. More specifically, there was prepared a developer consisting of 98 parts by weight (15 pounds) of the same carrier as used above by blending in a Lodige blender 15 pounds of carrier with 0.3 parts by weight of a toner composition with a medium diameter of 5.3 microns, this blending being affected for 20 minutes. Thereafter, there was added 1.9 parts by weight of a toner composition, with an average diameter of 11.4 microns, followed by blending the resulting mixture for 5 minutes. The triboelectric charge on the toner composition as determined by the Faraday Cage apparatus remained at 21 microcoulombs per gram for over 40,000 imaging cycles in a Xerox Corporation 1075®, reference FIG. 1, curve A.

The toner composition selected in each instance, curves A and B, was comprised of 92 percent by weight of a styrene n-butylmethacrylate copolymer, 6 percent by weight of carbon black particles; and 2 percent by weight of cetyl pyridinium chloride.

EXAMPLE II

A developer composition was prepared in accordance with the process of the present invention by repeating the procedure of Example I, reference FIG. 1, curve A, with the exception that there was selected a shorter dry mixing time for the oxidized steel core and polyvinylidene fluoride particles; that is, 48 minutes rather than 70 minutes, to yield a carrier with higher triboelectric charging ability; that is 44 microcoulombs per gram, as compared to 36 microcoulombs per gram for the carrier of Example I. There was selected for further blending 0.6 parts by weight of the toner composition with an average diameter of 4.6 microns. Subsequent to blending for 45 minutes there was added 1.7 parts by weight of the toner composition with an average diameter of 11.4 microns; and thereafter the resulting mixture was blended for five minutes.

Figure 2:
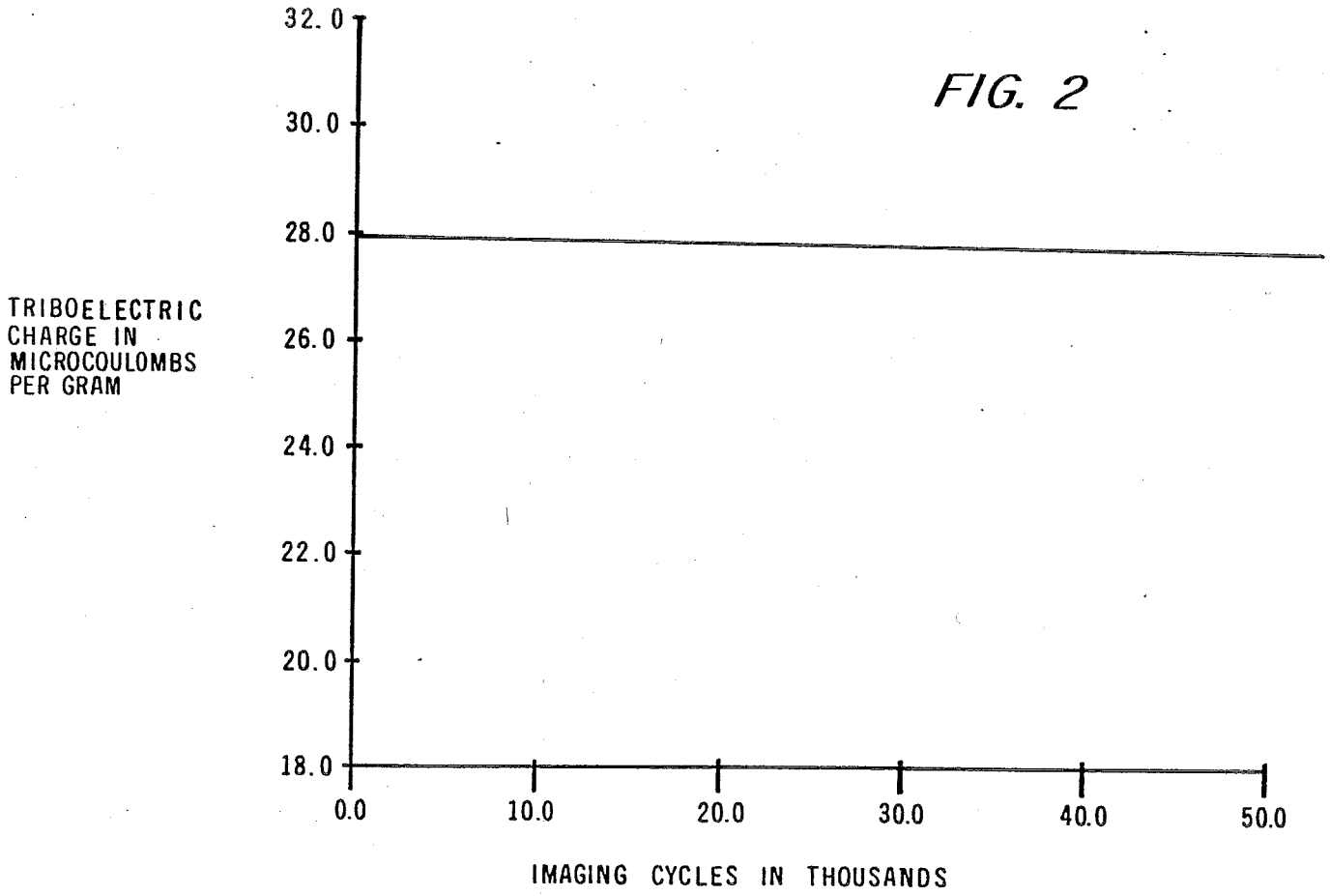

The toner had a triboelectric charge of 28 microcoulombs per gram, as determined in the Faraday Cage apparatus, and the developer exhibited a stable triboelectric charging value of about 28 microcoulombs per gram for 50,000 imaging cycles in a Xerox Corporation 1075® copying apparatus, reference FIG. 2.

EXAMPLE III

A developer composition was prepared by repeating the procedure of Example II with the exception that different amounts and sizes of toner were used in the blending steps. The carrier particles, 1100 pounds, were thus blended with 0.15 parts by weight of toner particles with a diameter of about 5 microns, which blending was affected for 45 minutes. Subsequently, 1.9 parts by weight of a toner composition with an average diameter of 10.8 microns was blended with the resulting mixture for 2 minutes.

Figure 3:
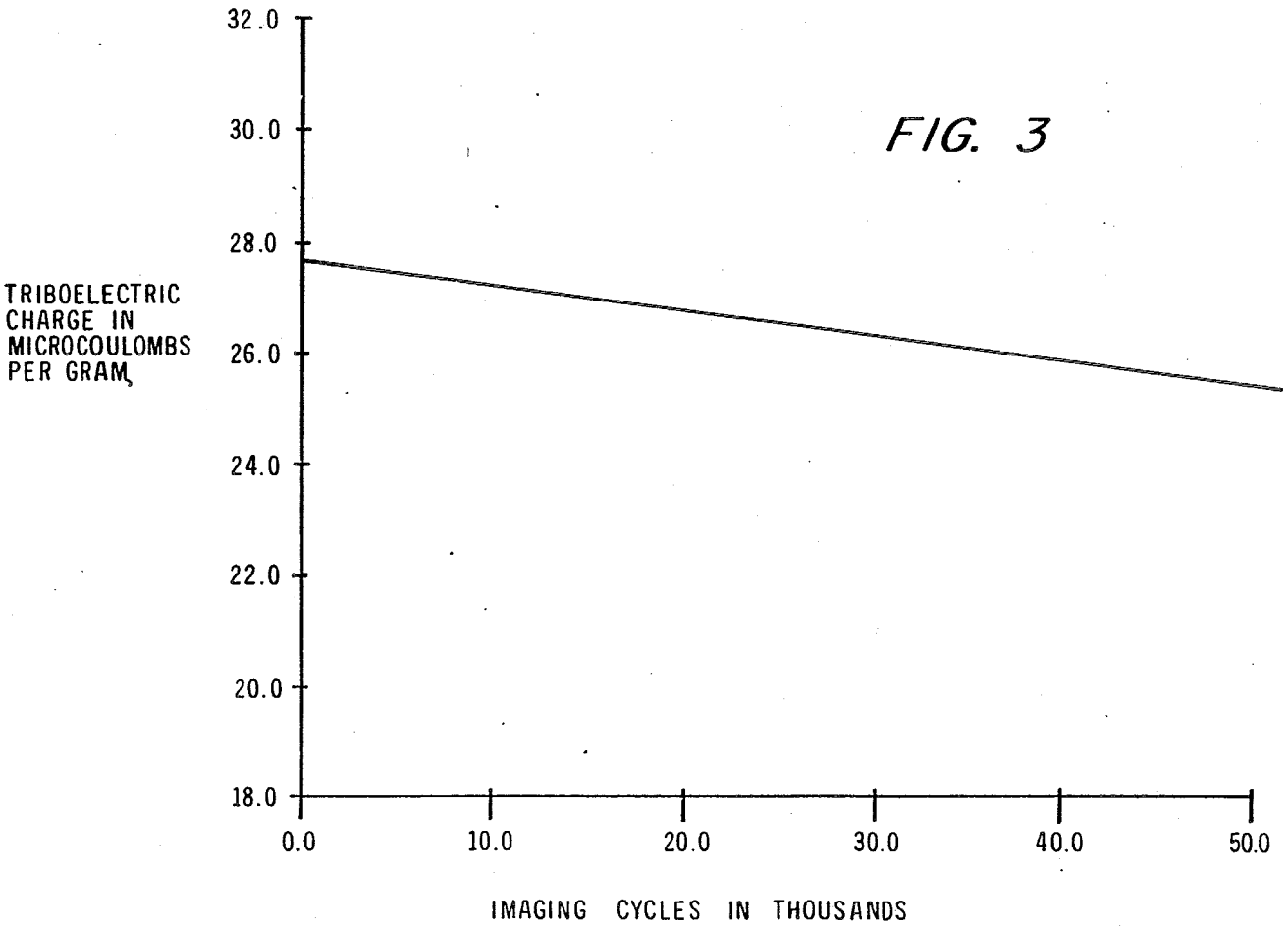

There was obtained on the toner particles a triboelectric charge of 27 microcoulombs per gram as determined by the Faraday Cage apparatus, and the developer charge was substantially constant for 50,000 imaging cycles in a Xerox Corporation 1075®, reference FIG. 3.

EXAMPLE IV

A developer composition was prepared by repeating the procedure of Example II with the exception that there resulted carrier particles with the same capacity for generating charge on the toner particles, that is 44 microcoulombs per gram. This carrier was prepared with an oxidized steel core available from Hoeganaes, and a semicontinuous coating thereover, 0.155 percent by weight of polyvinylidene fluoride. These components were blended for 30 minutes prior to fusing. Subsequently, the carrier particles, 1,100 pounds, were blended with 0.6 percent by weight of toner particles, average diameter of 4.9 microns, for 50 minutes, followed by five minutes of blending with a toner composition of a particle size diameter of 11.5 microns.

Figure 4:
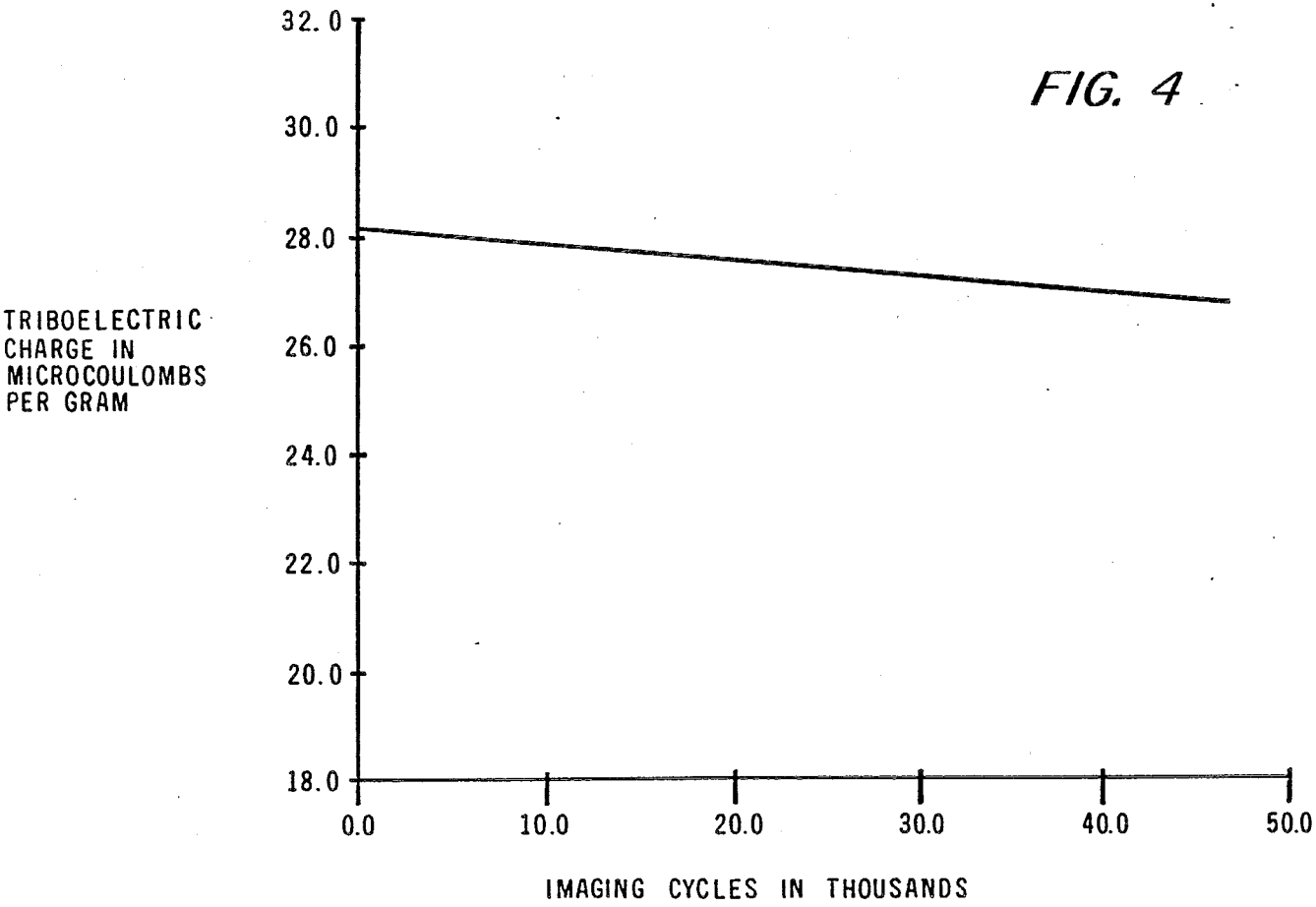

The toner composition had a triboelectric charge of about 28 microcoulombs per gram, and the developer charge was substantially constant for 50,000 imaging cycles in the Xerox Corporation 1075® imaging apparatus, reference FIG. 4. Thus, the developer of this example exhibited only a minor loss in charging properties over 50,000 imaging cycles.

Also, the developer of Example I, prepared by the process of the prior art, had a conductivity of $6 \cdot 10^{-10}$ to $2 \cdot 10^{-8}$ (ohm-cm)$^{-1}$, as compared to a conductivity of $1 \cdot 10^{-8}$ to $3 \cdot 10^{-8}$ for the developer prepared in accordance with the process of the present invention. The conductivity of the developer of Example II was $10^{-9}$ to $10^{-8}$; and for the developer of Example IV, the conductivity was $5 \cdot 10^{-8}$ (ohm-cm)$^{-1}$.

In each of the examples, reference to toner composition refers to that composition with 92 percent by weight of a styrene n-butylmethacrylate copolymer, 6 percent by weight of carbon black particles, and 2 percent by weight of cetyl pyridinium chloride.

Further, images of high resolution, that is excellent solid areas and no background deposits, were observed for 50,000 imaging cycles in the Xerox Corporation 1075® with the developer compositions prepared in accordance with the process of the present invention, reference the appropriate segment of Example I, and Examples II to IV.

Other modifications of the present invention may occur to those skilled in the art based upon a reading of the present disclosure and these modifications are intended to be included within the scope of the present invention.

What is claimed is:

1. A process for the preparation of developer compositions which comprises (1) providing carrier particles consisting of a core with an optional coating thereover; (2) introducing the carrier particles into a blending apparatus; (3) adding to the blending apparatus classified toner particles with a diameter of from about 2 microns to about 10 microns, said particles being comprised of toner resin particles, pigment particles, and a charge enhancing additive; (4) affecting blending for a period of time sufficient to enable the classified toner particles to alter the tribocharging ability of the carrier particles and become embedded therein; (5) subsequently adding to the resulting blended mixture toner particles of a diameter of from about 6 to about 18 microns, and comprised of toner resin particles, pigment particles, and a charge enhancing additive; wherein the amount of change enhancing additive in step (3) is from about 0.1 percent by weight to about 20 percent by weight and the amount of change enhancing additive present in step (5) in from about 0.1 percent by weight to about 30 percent by weight and (6) blending for a period of from about 1 minute to about 5 minutes.

2. A process in accordance with claim 1 wherein the carrier particles consist of a steel core containing a coating thereover.

3. A process in accordance with claim 1 wherein the carrier particles are formulated by the steps of mixing low density, porous, magnetic or magnetically-attractable metal carrier core particles having a gritty, oxidized surface and a surface area of at least about 200 $cm^2$/gram and up to about 1300 $cm^2$/gram of said carrier particles, with from between about 0.05 percent and about 3.0 percent by weight based on the weight of the coated carrier particles of particulate thermoplastic resin material having a particle size of between about 0.1 micron and about 30 microns; dry mixing said carrier core particles and said thermoplastic resin material until said thermoplastic resin material adheres to said carrier core particles by mechanical impaction or electrostatic attraction; heating the mixture of carrier core particles and thermoplastic resin material to a temperature of between about 320° F. and about 650° F. for between about 120 minutes and about 20 minutes causing the thermoplastic resin material to melt and fuse to said carrier core particles; cooling the coated carrier particles; and classifying said coated carrier particles to the desired particle size.

4. A process in accordance with claim 1 wherein the carrier particles are present in the blending apparatus in an amount of from about 95 percent by weight to about 99 percent by weight.

5. A process in accordance with claim 1 wherein the clasified toner particles are of a diameter of from about 3 to about 7 microns.

6. A process in accordance with claim 1 wherein the toner particles added to the blended mixture are of a diameter of from about 7 to about 12 microns.

7. A process in accordance with claim 1 wherein the toner resin particles are comprised of a styrrene n-butylmethacrylate copolymer.

8. A process in accordance with claim 1 wherein the pigment particles are carbon black.

9. A process in accordance with claim 1 wherein the charge enhancing additive is cetyl pyridinium chloride.

10. A process in accordance with claim 1 wherein the step (4) mixture is blended from about 20 minutes to about 90 minutes.

11. A process in accordance with claim 1 wherein the step (6) blending is accomplished for a period of about 2 minutes.

12. A process in accordance with claim 1 wherein there results on the toner composition a positive triboelectric charging value of from about 15 microcoulombs per gram to about 35 microcoulombs per gram.

13. A process in accordance with claim 12 wherein the triboelectric charging value is substantially stable beginning with the first imaging cycle.

14. A process in accordance with claim 1 wherein the toner particles possess a positive triboelectric charging value of from about 20 to about 30 microcoulombs per gram for a period of from about 1 imaging cycle to about 300,000 imaging cycles.

15. A process in accordance with claim 1 wherein the carrier particles conftain thereover a coating.

16. A process in accordance with claim 15 wherein the coating is continuous.

17. A process in accordance with claim 15 wherein the coating is semicontinuous.

18. A process in accordance with claim 15 wherein the coating is comprised of a fluoropolymer.

19. A process in accordance with claim 18 wherein the fluoropolymer is polyvinylidene fluoride.

20. A process in accordance with claim 1 wherein there results a developer composition with a conductivity of from about $10^{-11}$ (ohm-cm)$^{-1}$ to about $10^{-7}$ (ohm-cm)$^{-1}$.

21. A process for the preparation of developer compositions with stable electrical properties which comprises (1) providing carrier particles consisting of a core with a coating thereover; (2) introducing the carrier particles in an amount of from 12 pounds to about 1,200 pounds into a blending apparatus; (3) adding to the blending apparatus in an amount of from about 0.1 percent by weight to about 1.2 percent by weight, based on the weight of the carrier particles, classified toner particles with an average diameter of from about 3 microns to about 7 microns, said particles being comprised of toner resin particles, pigment particles, and a charge enhancing additive; (4) affecting blending for about 20 minutes to about 90 minutes enabling the classified toner particles to alter the tribogenerating ability of the carrier particles and become embedded therein; (5) subsequently adding to the resulting blended mixture toner particles in an amount of from about 0.8 percent by weight to about 2.5 percent by weight, based on the weight of the carrier particles, which toner particles are of a diameter of from about 6 to about 18 microns, and are comprised of toner resin particles, pigment particles, and a charge enhancing additive; wherein the amount of change enhancing additive in step (3) is from about 0.1 percent by weight to about 20 percent by weight and the amount of charge enhancing additive pdesent in step (5) is from about 0.1 percent by weight to about 20 percent by weight and (6) blending for a period of from about 1 minute to about 5 minutes.

22. A process in accordance with claim 1 wherein the coating is selected from the group consisting of polyvinylidene fluorides, and a methyl terpolymer of styrene, methacrylate, and an organo silane.

23. A process in accordance with claim 21 wherein the toner resin particles are comprised of a styrene n-butylmethacrylate copolymer.

24. A process in accordance with claim 21 wherein the charge enhancing additive is cetyl pyridinium chloride.

25. A process in accordance with claim 21 wherein the pigment particles are carbon black.

26. A process for the preparation of developer compositions consisting essentially of (1) providing carrier particles consisting of a core with an optional coating thereover; (2) introducing the carrier particles into a blending apparatus; (3) adding to the blending apparatus classified toner particles with a diameter of from about 2 microns to about 10 microns, said particles being comprised of toner resin particles, pigment particles, and a charge enhancing additive in an amount of from about 0.1 percent by weight to about 20 percent by weight; (4) affecting blending for a period of time sufficient to enable the classified toner particles to alter the tribocharging ability of the carrier particles and become embedded therein; (5) subsequently adding to the resulting blended mixture toner particles of a diameter of from about 6 to about 18 microns, and comprised of toner resin particles, pigment particles, and a charge enhancing additive in an amount of from about 0.1 percent by weight to about 20 percent by weight; and (6) blending for a period of from about 1 minute to about 5 minutes.

27. A process for the preparation of developer compositions with stable electrical properties consisting essentially of (1) providing carrier particles consisting of a core with a coating thereover; (2) introducing the carrier particles in an amount of from about 12 pounds to about 1,200 pounds into a blending apparatus; (3) adding to the blending apparatus in an amount of from about 0.1 percent by weight to about 1.2 percent by weight, based on the weight of the carrier particles, classified toner particles with a diameter of from about 3 microns to about 7 microns, said particles being comprised of toner resin particles, pigment particles, and a charge enhancing additive in an amount of from about 0.1 percent by weight to about 20 percent by weight; (4) affecting blending for about 20 minutes to about 90 minutes enabling the classified toner particles to alter the tribogenerating ability of the carrier particles and become embedded therein; (5) subsequently adding to the resulting blended mixture toner particles in an amount of from about 0.8 percent by weight to about 2.5 percent by weight, based on the weight of the carrier particles, which toner particles are of a diameter of from about 6 to about 18 microns, and a charge enhancing additive in an amount of from about 0.1 percent by weight to about 20 percent by weight; and (6) blending for a period of from about 1 minute to about 5 minutes.

28. A process in accordance with claim 21 wherein there results developer compensating with a conductivity of $10^{-11}$ (ohm-cm)$^{-1}$ to about $10^{-7}$ (ohm-cm)$^{-1}$.

29. A process for the preparation of developer compositions consisting essentially of (1) providing carrier particles consisting of a core with an optional coating thereover; (2) introducing the carrier particles into a blending apparatus; (3) adding to the blending apparatus classified toner particles with a diameter of from about 3 microns to about 7 microns, said particles being comprised of toner resin particles, pigment particles, and a charge enhancing additive in an amount of from about 0.1 percent by weight to about 20 percent by weight; (4) affecting blending for a period of time sufficient to enable the classified toner particles to alter the tribocharging ability of the carrier particles and become embedded therein; (5) subsequently adding to the resulting blended mixture toner particles of a diameter of from about 8 to about 14 microns, and comprised of toner resin particles, pigment particles, and a charge enhancing additive in an amount of from about 0.1 percent by weight to about 20 percent by weight; and (6) blending for a period of from about 1 minute to about 5 minutes.

30. A process in accordance with claim 29 wherein the carrier particles consist of a steel core containing a coating thereover.

31. A process in accordance with claim 1 wherein the toner particles of step (5) have an average diameter of about 11 microns.

32. A process in accordance with claim 1 wherein the average diameter of the toner particles for step (2) is from about 2 to about 5 microns, and the average diameter of the toner particles for step (5) is from about 10 to about 15 microns.

* * * * *